US007281476B2

(12) United States Patent
Mills et al.

(10) Patent No.: US 7,281,476 B2
(45) Date of Patent: Oct. 16, 2007

(54) BOOK RACK AND PENCIL TRAY COMBINATION

(75) Inventors: Robert J. Mills, Torrance, CA (US); Peter Glass, Arroyo Grande, CA (US)

(73) Assignee: Virco Mgmt. Corporation, Torrance, CA (US)

( * ) Notice: Subject to any disclaimer, the term of this patent is extended or adjusted under 35 U.S.C. 154(b) by 141 days.

(21) Appl. No.: 10/712,286

(22) Filed: Nov. 12, 2003

(65) Prior Publication Data

US 2005/0098069 A1 May 12, 2005

(51) Int. Cl.
*A47B 57/00* (2006.01)
*A47B 85/00* (2006.01)
*A47B 83/00* (2006.01)

(52) U.S. Cl. ..... 108/93; 108/101; 108/25; 312/235.9

(58) Field of Classification Search ..... 108/92, 108/93, 101, 26, 25; 312/235.9, 194, 228.1, 312/410; 211/90.03, 11, 181.1, 126.1, 126.2, 211/128.1, 69.1; 206/371; 297/135; 220/495, 220/488, 491, 487
See application file for complete search history.

(56) References Cited

U.S. PATENT DOCUMENTS 1,678,375 A * 7/1928 Berssenbrugge ..... 248/220.1
1,979,773 A * 11/1934 Ritch ..... 211/69.1
D101,639 S 10/1936 Larsen
D111,953 S 11/1938 Bond, Jr.
2,140,635 A 12/1938 Konarski
D114,767 S 5/1939 Robb
2,162,560 A 6/1939 Larsen
2,185,907 A * 1/1940 De Vaughn ..... 108/26
D119,253 S 3/1940 Balleydier
D123,202 S 10/1940 Levi
2,287,614 A 6/1942 Hawkins
D148,956 S 3/1948 Rhodes
2,459,257 A 1/1949 Wood
D156,695 S 1/1950 Brafman
D159,975 S 9/1950 Gilkison
D159,992 S 9/1950 Kump, Jr.
2,535,743 A * 12/1950 Lundahl ..... 400/717
D163,170 S 5/1951 Eibetz
D164,099 S 7/1951 Choate
D165,733 S 1/1952 Bargen
D169,012 S 3/1953 Musacco
2,632,496 A 3/1953 Willis et al.
2,661,049 A 12/1953 Sebel
2,676,646 A 4/1954 Brashear, Jr.
2,683,640 A * 7/1954 Mangine ..... 248/231.71
2,707,141 A * 4/1955 Witter ..... 108/26

(Continued)

*Primary Examiner*—Janet M. Wilkens
*Assistant Examiner*—Timothy M. Ayres
(74) *Attorney, Agent, or Firm*—Sheldon Mak Rose & Anderson; Denton L. Anderson; Robert M. Hupe

(57) ABSTRACT

A book rack and pencil tray combination has a book rack and a pencil case attached to the bottom wall of the book rack. The pencil case is optionally attached to the bottom wall of the book rack by a pencil case attachment plate attached to the bottom wall of the pencil case. The pencil case attachment plate is typically attached to the bottom wall of the pencil case such that a portion of the bottom wall of the book rack is sandwiched between the pencil case attachment plate and the bottom wall of the pencil case.

6 Claims, 3 Drawing Sheets

U.S. PATENT DOCUMENTS 2,729,529 A * 1/1956 Nordmark et al. ..... 312/108
D176,881 S 2/1956 Phillips
D178,989 S 10/1956 Eilert
2,846,285 A * 8/1958 Wright ..... 312/351.4
D190,570 S 6/1961 Pfau
3,161,161 A * 12/1964 Reinke ..... 108/81
3,273,839 A * 9/1966 Bennett ..... 248/73
D207,262 S 3/1967 Maurer et al.
D226,066 S 1/1973 Barecki
3,758,182 A * 9/1973 Barecki et al. ..... 312/194
D239,793 S 5/1976 Jones
4,067,631 A 1/1978 Kelley
D283,563 S 4/1986 Arroyo
4,646,921 A * 3/1987 Canter ..... 211/126.1
5,263,578 A * 11/1993 Narvey ..... 206/232
5,265,735 A * 11/1993 Hassel et al. ..... 211/11
5,494,308 A * 2/1996 Southerland ..... 280/33.992
5,623,881 A * 4/1997 Huang ..... 108/50.01
5,626,394 A 5/1997 Perry
6,039,392 A 3/2000 Dencker
6,056,178 A * 5/2000 Rapp-Duncan ..... 224/411
6,283,042 B1 * 9/2001 Wargo et al. ..... 108/26
6,298,793 B1 * 10/2001 Turner et al. ..... 108/26
D475,207 S 6/2003 Bosman et al.
D477,921 S 8/2003 Bosman et al.
2003/0177959 A1 * 9/2003 Phillips ..... 108/92
2004/0035332 A1 * 2/2004 Lin ..... 108/50.01

* cited by examiner 10
12
15
16
14
14
14
14
13
20
18
22

BOOK RACK AND PENCIL TRAY COMBINATION

FIELD OF THE INVENTION

This invention relates generally to furniture and, more particularly, to accessories for student desks.

BACKGROUND OF THE INVENTION

Desks for students in classroom settings are frequently of a simple design comprising a desk top and supporting legs. To provide the student with a compartment for storing books and notebooks, manufacturers have sometimes added a book rack to the underside of the desk top. At the request of many school districts, such a book rack is often made from a wire mesh or is otherwise made intentionally "porous" to make it difficult for a student to hide inappropriate objects within the book rack. Unfortunately, although such wire mesh or otherwise "porous" book racks are useful in retaining large items, such as books and notebooks, they are unsuitable for retaining smaller items, such as pencils, pens and rulers. There is therefore a need in the prior art for a book rack which overcomes this problem in the prior art.

SUMMARY

The invention satisfies this need. The invention is a book rack and pencil tray combination comprising (a) a book rack having a front opening and a bottom wall, the bottom wall having at least one opening, and (b) a pencil case attached to the book rack.

DRAWINGS

These features, aspects and advantages of the present invention will become better understood with regard to the following description, appended claims and accompanying figures where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

In one embodiment, the invention is a book rack and pencil tray combination 18 comprising a book rack 20 and a pencil case 22. In another embodiment, the invention is a desk 10 to which is attached such a book rack and pencil tray combination 18.

Figure 1:
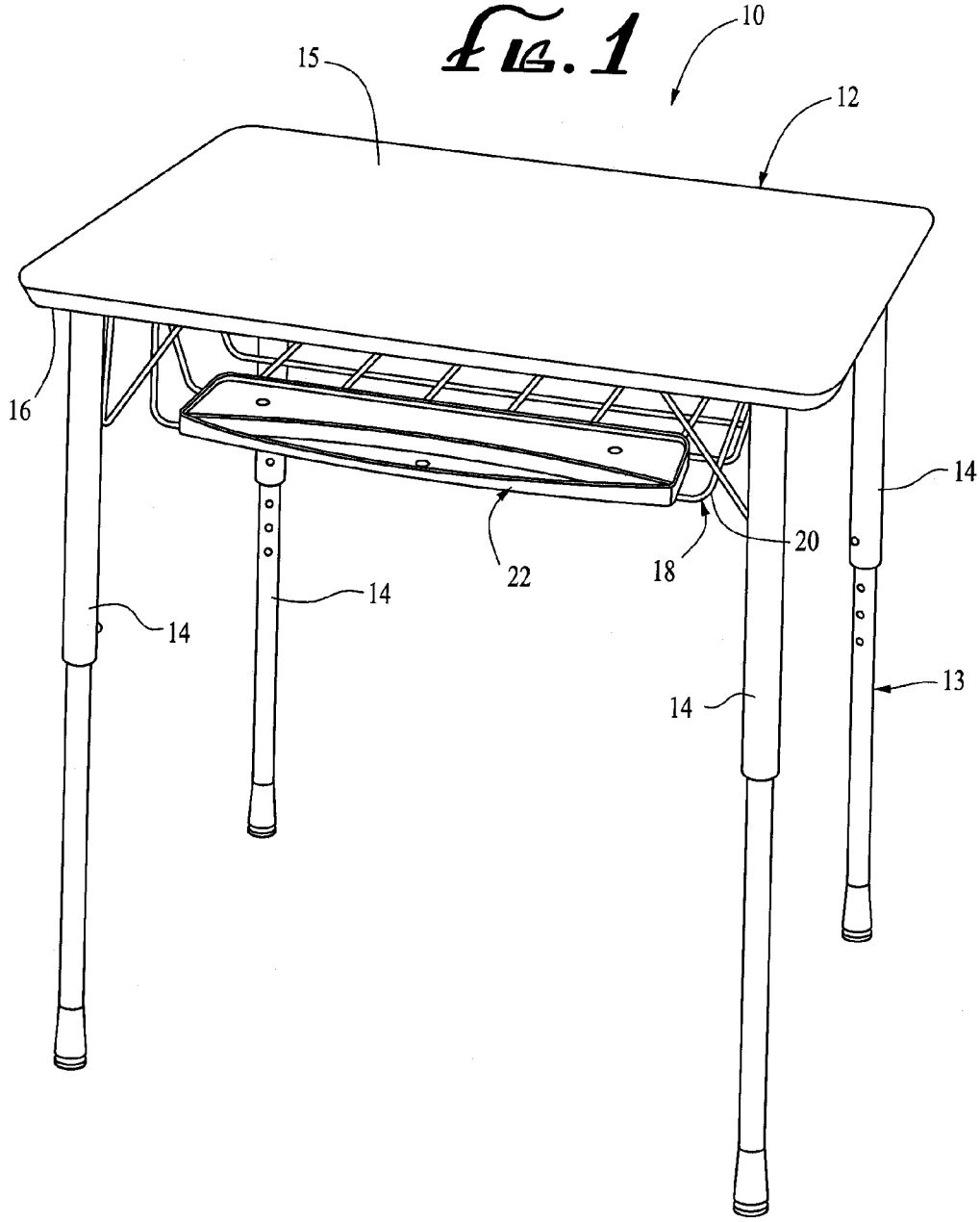
FIG. 1 is a perspective view of a book basket and pencil tray combination having features of the invention.

FIG. 1 illustrates a desk 10 having a desk top 12 and a support structure 13 to support the desk top 12 at an elevation above floor level. In the embodiment illustrated in the drawings, the support structure 13 comprises four vertically adjustable legs 14. The desk top 12 has a top surface 15 suitable for working upon, and a bottom surface 16.

Figure 2:
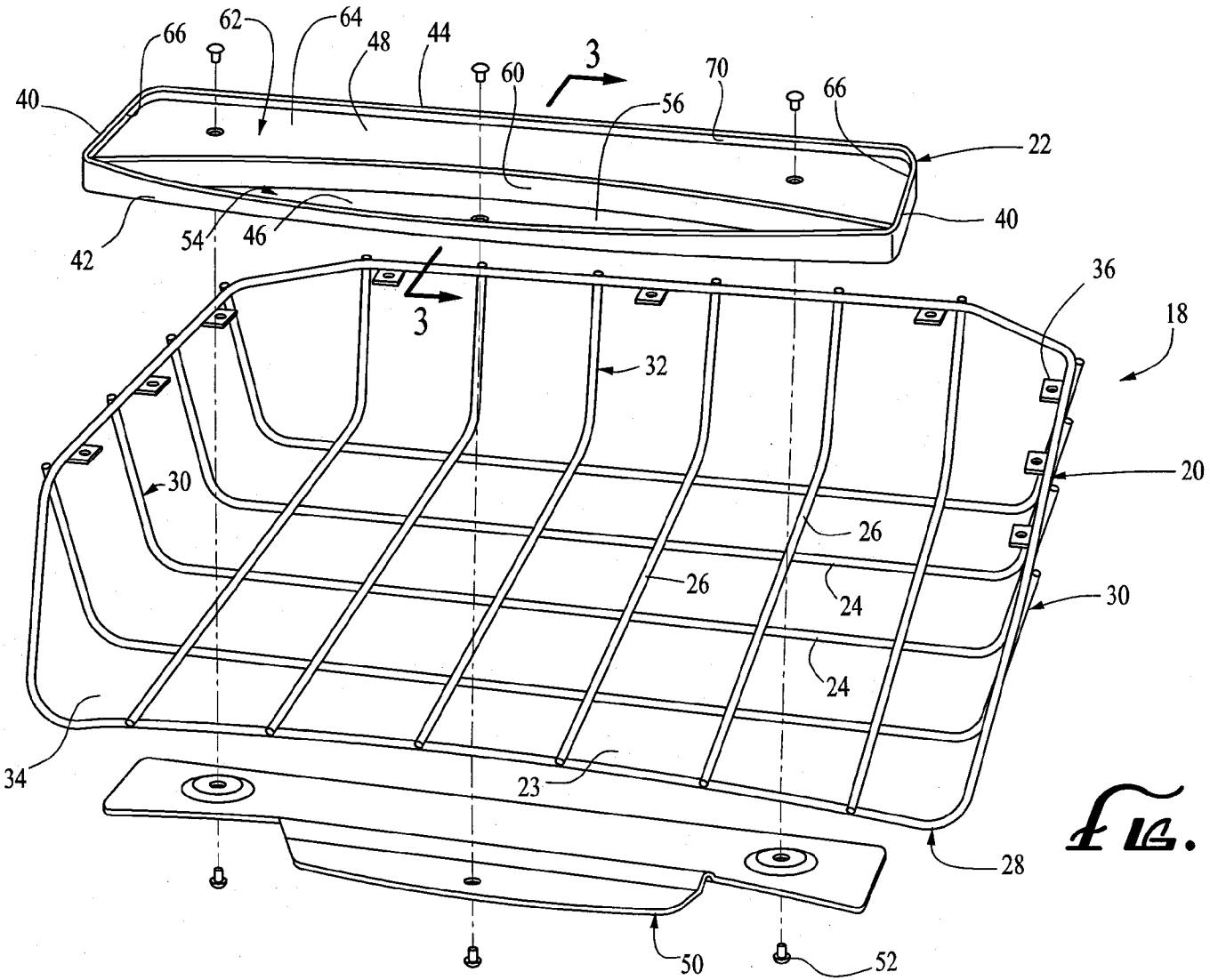
FIG. 2 is an exploded view of the combination illustrated in FIG. 1.
Figure 3:
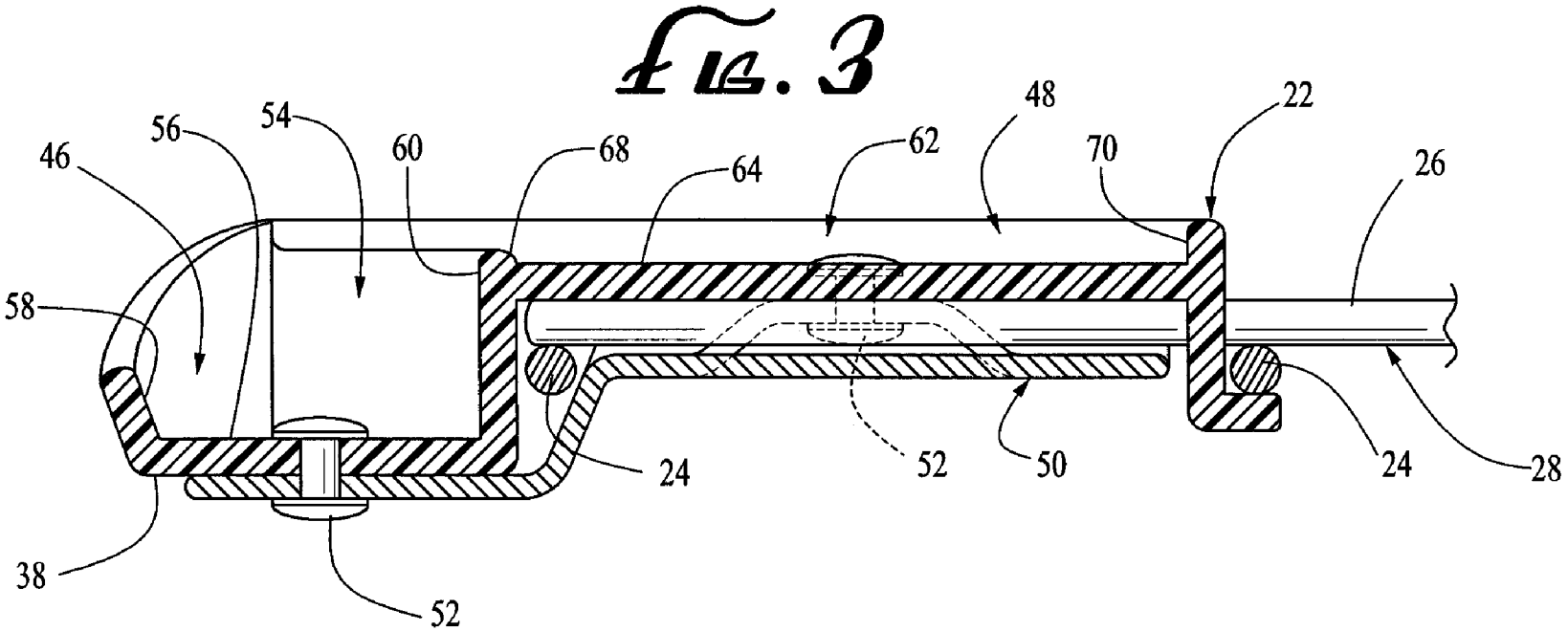
FIG. 3 is a cross-sectional view of the combination illustrated in FIGS. 1 and 2, taken along line 3-3.

Attached to the bottom surface 16 of the desk top 12 is the book rack and pencil tray combination 18 of the invention. The book rack and pencil tray 18 combination is more fully illustrated in FIGS. 2 and 3.

The book rack and pencil tray combination 18 comprises the book rack 20 and the pencil tray 22. The book rack 20 has a front opening 34 and bottom wall 28. The bottom wall 28 has at least one opening 23. In a typical embodiment, such as the embodiment illustrated in the drawings, the book rack 20 is of wire mesh design, typically comprising a plurality of parallel, spaced apart first support members 24 to which are each attached a plurality of parallel, spaced apart second support members 26. The second support members 26 are typically disposed at right angles to the first support members 24, such as that which is illustrated in the drawings. The first support members 24 are typically attached to the second support members 26 by an adhesive or some form of welding process. The first support members 24 and the second support members 26 are typically made of steel, although fiberglass, plastics and other metals can also be used. Where the material is a metal, it is typically painted or coated with a corrosion resistant material.

The book rack 20 optionally also comprises a pair of opposed side walls 30 and a rear wall 32. The book rack 20 can also comprise clips 36 or other similar accessories to facilitate the attachment of the book rack 20 to the bottom surface 16 of the desk top 12.

The pencil case 22 is typically made from a plastic material. Other materials, such as woods, fiberglass and metals, can also be used. The pencil case 22 typically has a bottom wall 38, a pair of opposed side walls 40, a front wall 42 and a rear wall 44.

The pencil case 22 can define one or more separate compartments. In the embodiment illustrated in the drawings, the pencil case 22 defines a pair of separate compartments, a lower compartment 46 and an upper compartment 48. The lower compartment 46 constitutes a first section 54 of the pencil case 22. The first section 54 comprises a bottom wall 56, a front wall 58 and a rear wall 60. The upper compartment constitutes a second section 62 of the pencil case 22, the second section 62 comprises a bottom wall 64, a pair of opposed side walls 66, a front wall 68 and a rear wall 70.

The lower compartment 46 can be relatively narrow and be suitable for retaining pens and pencils. The upper compartment 48 can be wider than the lower compartment 46 and be therefore suitable for retaining rulers, protractors and the like. In the embodiment illustrated in the drawings, the lower compartment 46 is disposed outside the front opening 34 of the book rack 20 for easy access to the lower compartment 46 and to allow for greater depth of the lower compartment 46 without restricting access to the book rack 20 through the front opening 34. Additionally, the lower compartment 46 is typically disposed in a generally horizontal plane which is at an elevation lower than the generally horizontal plane within which the bottom wall 28 of the book rack 20 is disposed.

The pencil case 22 is firmly attached to the book rack 20. In the embodiment illustrated in the drawings, the pencil case 22 is firmly attached to the bottom wall 28 of the book rack 20 by a pencil case attachment plate 50. The pencil case attachment plate 50 can be made from a metal, such as steel, or from other materials, such as fiber glass, plastics or woods. The pencil case attachment plate 50 is attached to the bottom wall 38 of the pencil case 22 by rivets 52, screws, bolts or other suitable attachment means. The pencil case attachment plate 50 is attached to the bottom wall 38 of the pencil case 22, such that a portion of the bottom wall 28 of the book rack 20 is sandwiched between the pencil case attachment plate 50 and the bottom wall 28 of the pencil case 22.

The invention provides a simple, efficient and inexpensive method of providing a desk with a wire mesh or otherwise "porous" book rack which is capable of retaining small objects, such as pens and rulers.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A book rack and pencil tray combination comprising:

(a) a wire mesh book rack having a bottom wall and a front opening;

(b) a pencil case having a first section with a bottom wall, a front wall and a rear wall, and a portion being sized to retain one or more of a ruler or a protractor within the walls of the first section, and a second section with a bottom wall, a front wall and a rear wall, the bottom wall of the second section being disposed in a generally horizontal plane at an elevation lower than the bottom wall of the first section; and (c) a pencil case attachment plate attached to the bottom walls of the first section and the second section such that a portion of the bottom wall of the book rack is sandwiched between the pencil case attachment plate and the bottom wall of the first section.

2. The combination of claim 1 wherein the pencil case defines a pair of separate compartments, a lower compartment and an upper compartment, and wherein the lower compartment is disposed outside the front opening of the book rack.

3. The combination of claim 2 wherein the bottom wall of the book rack is disposed in a generally horizontal first plane and the lower compartment of the pencil case is disposed in a second generally horizontal plane, the second plane being disposed at an elevation below the first plane.

4. A desk comprising:

(a) a desk top having a top surface and a bottom surface;

(b) a support structure for supporting the desk top at an elevation above floor level;

(c) a wire mesh book rack having a bottom wall and a front opening;

(d) a pencil case having a first section with a bottom wall, a front wall and a rear wall, and a portion being sized to retain one or more of a ruler or a protractor within the walls of the first section, and a second section with a bottom wall, a front wall and a rear wall, the bottom wall of the second section being disposed in a generally horizontal plane at an elevation lower than the bottom wall of the first section; and (e) a pencil case attachment plate attached to the bottom walls of the first section and the second section such that a portion of the bottom wall of the book rack is sandwiched between the pencil case attachment plate and the bottom wall of the first section.

5. The combination of claim 4 wherein the pencil case defines a pair of separate compartments, a lower compartment and an upper compartment, and wherein the lower compartment is disposed outside the front opening of the book rack.

6. The combination of claim 5 wherein the bottom wall of the book rack is disposed in a generally horizontal first plane and the lower compartment of the pencil case is disposed in a second generally horizontal plane, the second plane being disposed at an elevation below the first plane.

* * * * *